US005503453A

United States Patent [19]

Saul et al.

[11] Patent Number: 5,503,453

[45] Date of Patent: Apr. 2, 1996

[54] TWO-WAY HIGH-LEG RECLINER

[75] Inventors: Jonathan R. Saul, LaSalle; Karl J. Komorowski, Petersburg; Larry P. LaPointe, Temperance, all of Mich.

[73] Assignee: La-Z-Boy Chair Company, Monroe, Mich.

[21] Appl. No.: 67,999

[22] Filed: May 27, 1993

[51] Int. Cl.[6] ..... A47C 1/034

[52] U.S. Cl. ..... 297/89

[58] Field of Search ..... 297/68, 84, 85, 297/88, 89

[56] References Cited

U.S. PATENT DOCUMENTS

| | | | |
|---|---|---|---|
| 2,575,221 | 11/1951 | Horner et al. | 297/440.16 |
| 2,875,813 | 3/1959 | Schliephacke . | |
| 2,880,784 | 4/1959 | Navelle et al. . | |
| 2,943,670 | 7/1960 | Hoffman, Jr. . | |
| 2,974,720 | 3/1961 | Jelinek | 297/89 X |
| 3,010,761 | 11/1961 | Teague, Jr. . | |
| 3,061,367 | 10/1962 | Schliephacke | 297/89 |
| 3,100,668 | 8/1963 | Rogers et al. | 297/89 |
| 3,244,448 | 4/1966 | Ré . | |
| 3,244,449 | 4/1966 | Ré . | |
| 3,279,847 | 10/1966 | Ré | 297/89 |
| 3,348,878 | 10/1967 | Rogers, Jr. . | |
| 3,357,739 | 12/1967 | Knabusch et al. . | |
| 3,359,034 | 12/1967 | Ré . | |
| 3,370,884 | 2/1968 | Rogers, Jr. . | |
| 3,494,660 | 2/1970 | Caldemeyer et al. . | |
| 4,216,992 | 8/1980 | Crum | 297/89 X |
| 4,291,913 | 9/1981 | Kowalski | 297/89 |
| 4,350,387 | 9/1982 | Rogers, Jr. . | |
| 4,627,663 | 12/1986 | LaPointe . | |
| 5,013,084 | 5/1991 | May . | |

*Primary Examiner*—Peter R. Brown
*Attorney, Agent, or Firm*—Harness, Dickey & Pierce

[57] ABSTRACT

An improved actuation mechanism is disclosed which is particularly well-suited for incorporation into "high-leg" reclining chairs. The actuation includes a swing linkage for coordinating the extensible movement of a leg rest assembly in response to reclining movement of a seat assembly with respect to the chair frame. An over-center biasing mechanism is provided for assisting in extending and retracting the leg rest assembly. Furthermore, the actuation mechanism also includes a tilt linkage for permitting the seat assembly to be independently tilted following extension of the leg rest assembly. The actuation mechanism also includes a mechanical stop arrangement is provided for positively defining the limits of retracted and extended movement of the leg rest assembly which, in conjunction with the over-center biasing mechanism, effectively inhibits undesirable droop of the leg rest assembly.

19 Claims, 5 Drawing Sheets

FIG 1
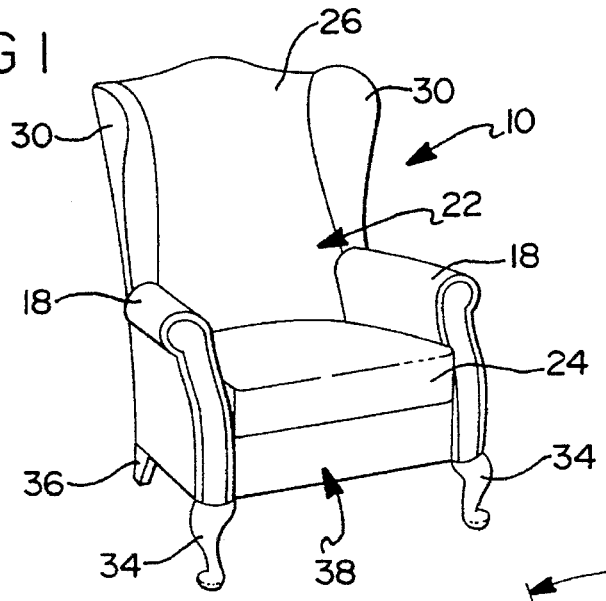
FIG 2A
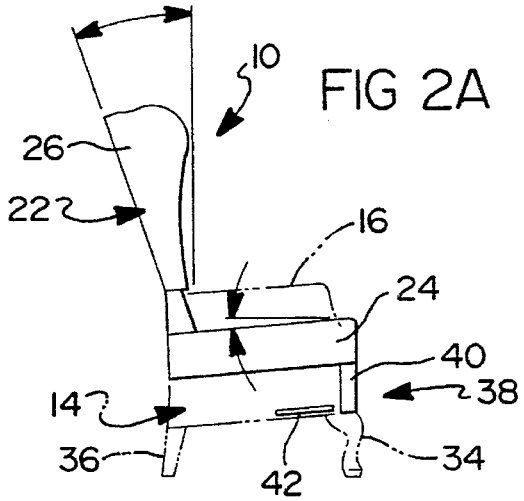
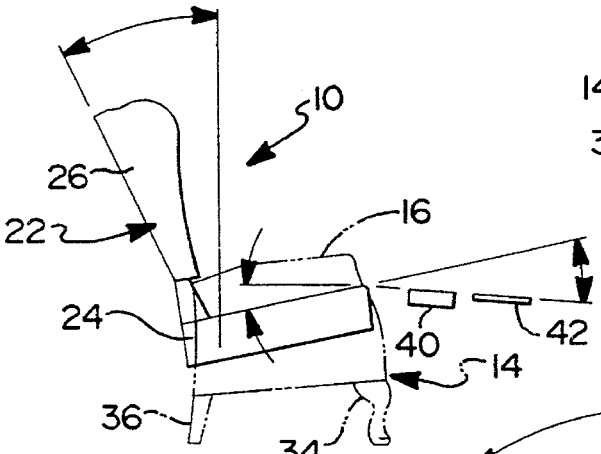
FIG 2B
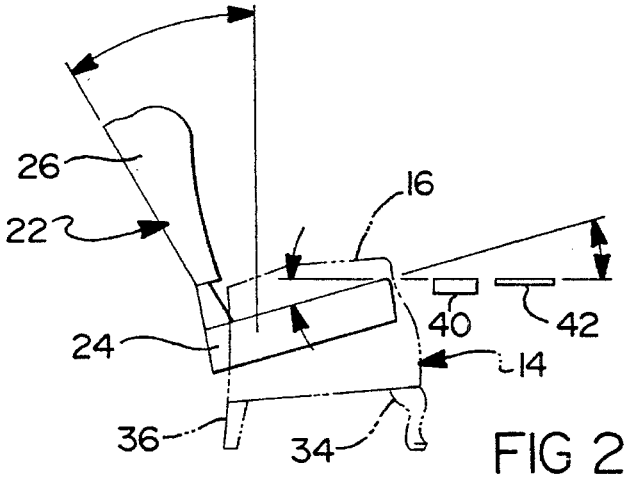
FIG 2C

TWO-WAY HIGH-LEG RECLINER

BACKGROUND OF THE INVENTION

This invention relates generally to reclining chairs and, in particular, to an improved actuation mechanism for use in high-leg reclining chairs.

Traditionally, reclining chairs are equipped with an actuation mechanism for operatively interconnecting a seat assembly to a stationary chair frame for movement between an "upright" position and various "reclined" positions. As an additional comfort feature, the actuation mechanism may also be adapted to move an extensible leg rest assembly between a retracted (i.e., "stowed") position and a protracted (i.e., "extended") operative position. Moreover, such actuation mechanisms typically include a combination of mechanical linkages that can be selectively actuated for causing concurrent and independent reclining movement of the seat assembly in coordination with extensible movement of the leg rest assembly.

In most reclining chairs, the actuation mechanism is concealed by a chair frame which extends substantially to the floor. However, it is also known to confine the actuation mechanism under the seat in chair frames that are supported "off-the-floor" on four exposed legs, such chairs being commonly referred to in the furniture industry as "high-leg" recliners. While a number of such high-leg recliners are currently known, furniture manufacturers are continually striving to develop improved actuation mechanisms for reducing system complexity and cost while concomitantly improving system operation and occupant comfort. Furthermore, there is a continuing desire to develop improved fabrication and assembly techniques which will result in reduced costs while promoting increased efficiency and improved product quality.

SUMMARY OF THE INVENTION

Accordingly, the present invention is generally directed to providing an improved actuation mechanism for use in high-leg reclining chairs. More specifically, the actuation mechanism of the present invention includes means for coordinating the reclining movement of a seat assembly and the extensible movement of a leg rest assembly relative to a stationary high-leg chair frame. As such, the seat assembly can be reclined between a normal "upright" position with the leg rest assembly retracted into a "stowed" position and a first reclined or "T.V." position with the leg rest assembly protracted to an "extended" operative position.

As a related object, the actuation mechanism of the present invention further includes means for tilting the seat assembly between the T.V. position and a second or "fully" reclined position while the leg rest assembly is maintained in its "extended" operative position.

Another object of the present invention is to provide a high-leg reclining chair wherein the forces achieved upon the seat occupant shifting his/her weight are utilized as the primary means for causing movement of the seat assembly between its various upright and reclined positions and movement of the leg rest assembly between its "stowed" and "extended" positions.

An additional object of the present invention is to provide an over-center biasing mechanism for assisting the seat occupant in extending and retracting the leg rest assembly. In addition, the over-center biasing mechanism is operable for retaining the leg rest assembly in one of its "stowed" and "extended" positions. Furthermore, a mechanical stop arrangement is provided for positively defining the limits of retracted and extended movement of the leg rest assembly which, in conjunction with the over-center biasing mechanism, effectively inhibits undesirable "droop" of the leg rest assembly in either of its "stowed" or "extended" positions.

Yet another salient object of the present invention is to provide the high-leg recliner chair with a "dual" leg rest assembly having a primary leg-rest segment and a secondary leg-rest segment, the segments being interconnected for articulated and concurrent movement between the leg rest "stowed" and "extended" positions.

It is still another object of the present invention to provide a high-leg reclining chair having pre-fabricated modular components which can be simply, efficiently, and rigidly assembled.

Various other objects, features and advantages of the present invention will become apparent to one skilled in the art from reading the following written description, taken in conjunction with the accompanying drawings and the appended claims.

DESCRIPTION Of THE DRAWINGS

FIG. 1 is a perspective view of an upholstered high-leg reclining chair embodying the features of the present invention;

FIG. 2A through 2C are schematic side views of the seat assembly and leg rest assembly for the high-leg reclining chair of FIG. 1, wherein FIG. 2A illustrates the seat assembly in a normal "upright" position with the leg rest assembly retracted to a "stowed" position, FIG. 2B shows the seat assembly reclined to a first reclined or "T.V." position with the leg rest assembly protracted to an "extended" operative position, and FIG. 2C illustrates angular movement of the seat assembly to a second or "fully" reclined position with the leg rest assembly maintained in its "extended" operative position;

DETAILED DESCRIPTION OF THE INVENTION

Figure 3:
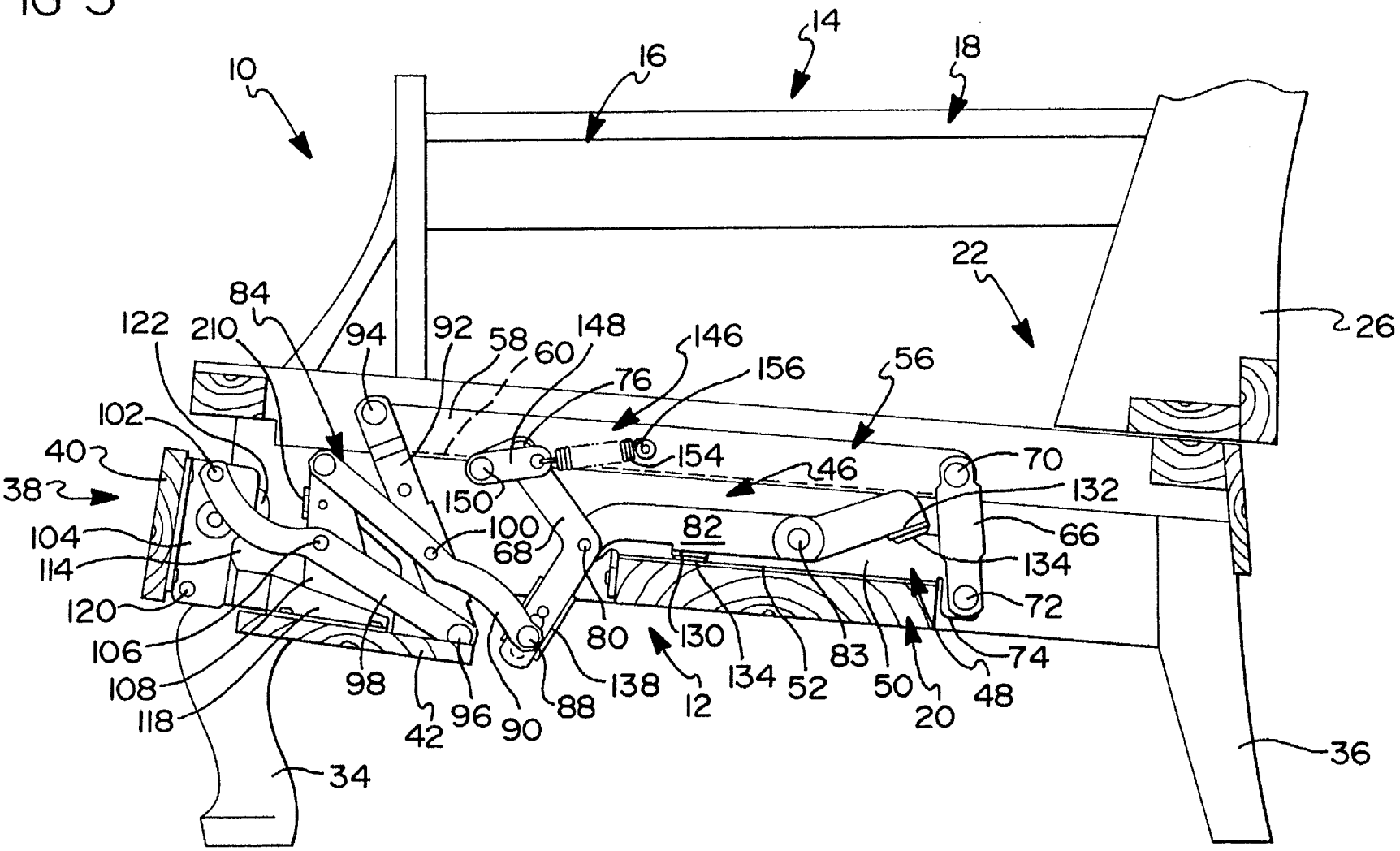
FIG. 3 is fragmentary sectional view of the high-leg reclining chair of FIG. 1, with its upholstery omitted and components broken away or omitted for clarity, illustrating the actuation mechanism when the reclining chair is in the conventional seat position of FIG. 2A.

In accordance with the teachings of the present invention, an improved actuation mechanism is disclosed which is particularly well-suited for incorporation into "high-leg" reclining chairs. In general, the designation "high-leg" reclining chair refers to a reclining chair having a stationary chair frame which is supported "off-the-floor" on four exposed legs such that the actuation mechanism is concealed under a seat portion thereof. As will be detailed, the improved actuation mechanism of the present invention includes means for coordinating reclining movement of a unitary seat assembly and articulated extensible movement of a leg rest assembly with respect to the high-leg chair frame. As such, the seat assembly can be reclined to any position between a normal "upright" position with the leg rest assembly retracted into a "stowed" position and a first reclined or "T.V." position with the leg rest assembly protracted to an "extended" operative position. Furthermore, the actuation mechanism of the present invention also includes means for permitting the seat assembly to be angularly tilted to any position between the first reclined position and a second or "fully" reclined position while the leg rest assembly is maintained in its "extended" operative position. Accordingly, the present invention discloses a "two-way" actuation mechanism that is compact in size and which permits the use of loose upholstered cushions which are modernly essential for marketing all styles of "high-leg" reclining chairs.

In the disclosed embodiment, the article of furniture is shown as a high-leg reclining chair 10 which includes various upholstered components and an actuation mechanism 12 that can be quickly and simply assembled as a seating unit. Such "modular" construction provides a significant advancement over conventional assembly techniques since manipulation of cumbersome unitary seat assemblies and/or chair frames is no longer required. To this end, a method of assembling the modular components will be hereinafter described in greater detail.

With reference to the drawings, the operative relationship of actuation mechanism 12 embodying the present invention will now be described in greater detail. More particularly, FIG. 1 shows an exemplary high-leg reclining chair 10, such as a Queen Anne wingback style chair, of the type having four exposed legs. More specifically, chair 10 has an upholstered chair frame 14 defined by a pair (i.e., left and right) of laterally spaced side members 16 that also provide chair arms 18, and a transverse cross member 20 which is rigidly secured between side members 16. An upholstered seat assembly 22 is supported for movement with respect to chair frame 14 and includes a seat member 24 and a seatback member 26. As will be described, seat assembly 22 includes detachable means 28 for permitting seatback member 26 to be removed from seat member 24 during assembly and shipping. In addition, seatback member 26 is shown as having a pair of laterally-spaced integral wings 30 which overlie side members 16 at rearward end portions of chair arms 18. Chair frame 14 also includes front corner posts 32 which are each shown to have a Queen Anne style leg 34 attached thereto, the rear of chair frame 14 providing a pair of rear legs 36. Thus, chair frame 14 is of the "high-leg" type that is adapted to support and conceal actuation mechanism 12. As will be detailed, actuation mechanism 12 supports seat assembly 22 for movement relative to stationary high-leg chair frame 14. In addition, actuation mechanism 12 supports an extensible leg rest assembly 38 from chair frame 14 for articulated movement with respect thereto.

Referring now to FIG. 2A through 2C of the drawings, various operational positions of seat assembly 22 and leg rest assembly 38 relative to high-leg chair frame 14 are schematically shown. More particularly, FIG. 2A illustrates seat assembly 22 in the "upright" position for permitting a seat occupant to enjoy conventional seating. In this conventional seat position, leg rest assembly 38 is retracted to the "stowed" position such that an upholstered primary leg-rest segment 40 is generally vertically aligned with front edge of chair frame 14 while an upholstered secondary leg-rest segment 42 is positioned along a substantially horizontal plane concealed within chair frame 14. FIG. 2B illustrates seat assembly 22 rearwardly displaced and angularly pivoted relative to chair frame 14 into the first reclined or "T.V." position while leg rest assembly 38 is protracted to the "extended" operative position. In response to movement of leg rest assembly 38 to the "extended" operative position, primary leg-rest segment 40 and secondary leg-rest segment 42 have been articulated into a substantially coplanar alignment. As will be discussed, actuation mechanism 12 is adapted to coordinate the concurrent movement of seat assembly 22 and leg rest assembly 38 between the positions shown in FIG. 2A and 2B. Finally, FIG. 2C illustrates angular tilted movement of seat assembly 22 from the T.V. position of FIG. 2B to the "fully" reclined position while leg rest assembly 38 is maintained in its "extended" operative position. Thus, such "tilting" movement of seat assembly 22 is independent of movement of leg rest assembly 38. As will also be detailed, the pressure applied by the seat occupant to seat assembly 22, chair arms 18 and/or leg rest assembly 38 is adapted to cause the above-noted coordinated and independent movements of seat assembly 22 and leg rest assembly 38 relative to chair frame 14.

Figure 4:
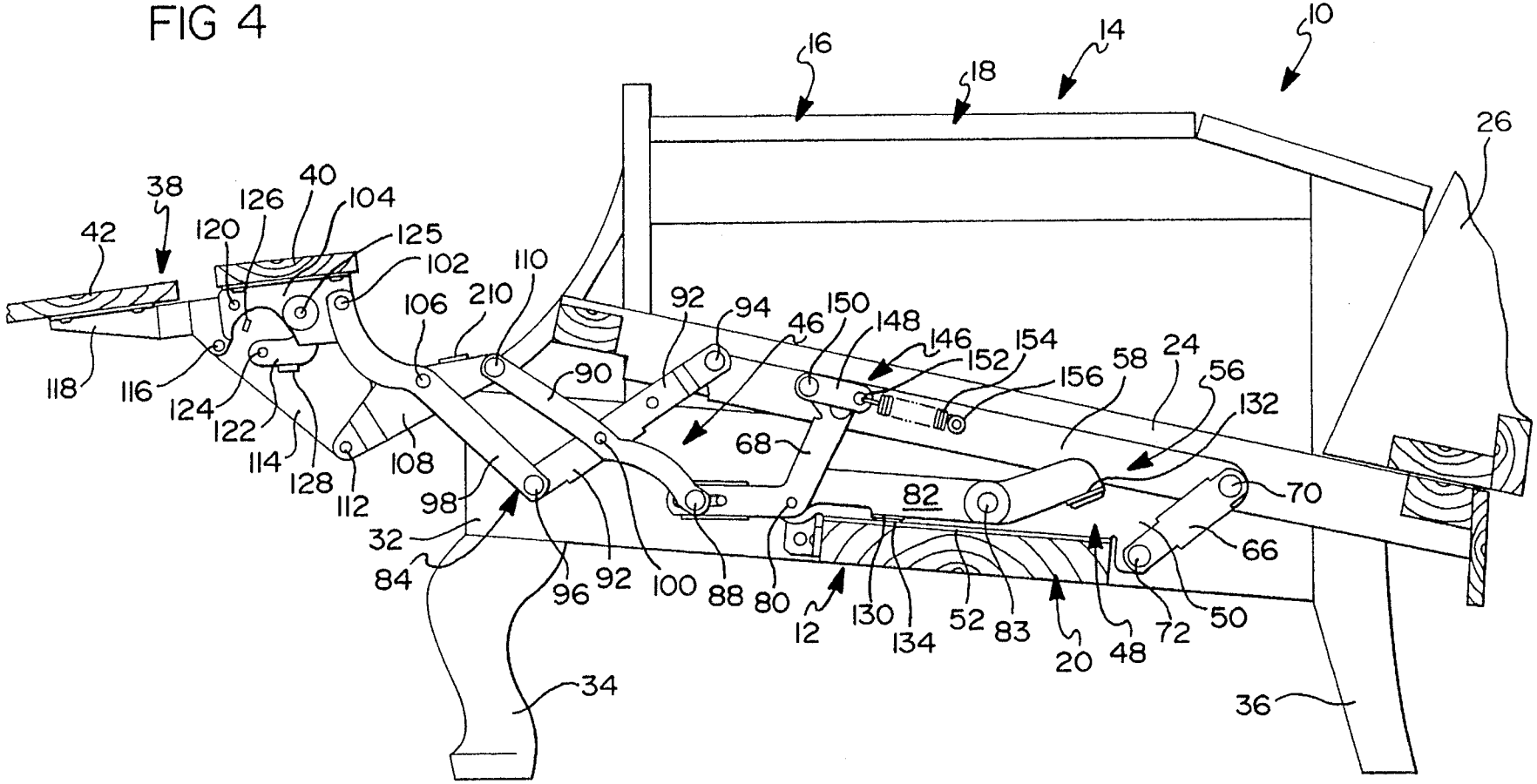
FIG. 4 is a side elevational view of the actuation mechanism when the high-leg reclining chair is in the "reclined" position of FIG. 2B.
Figure 5:
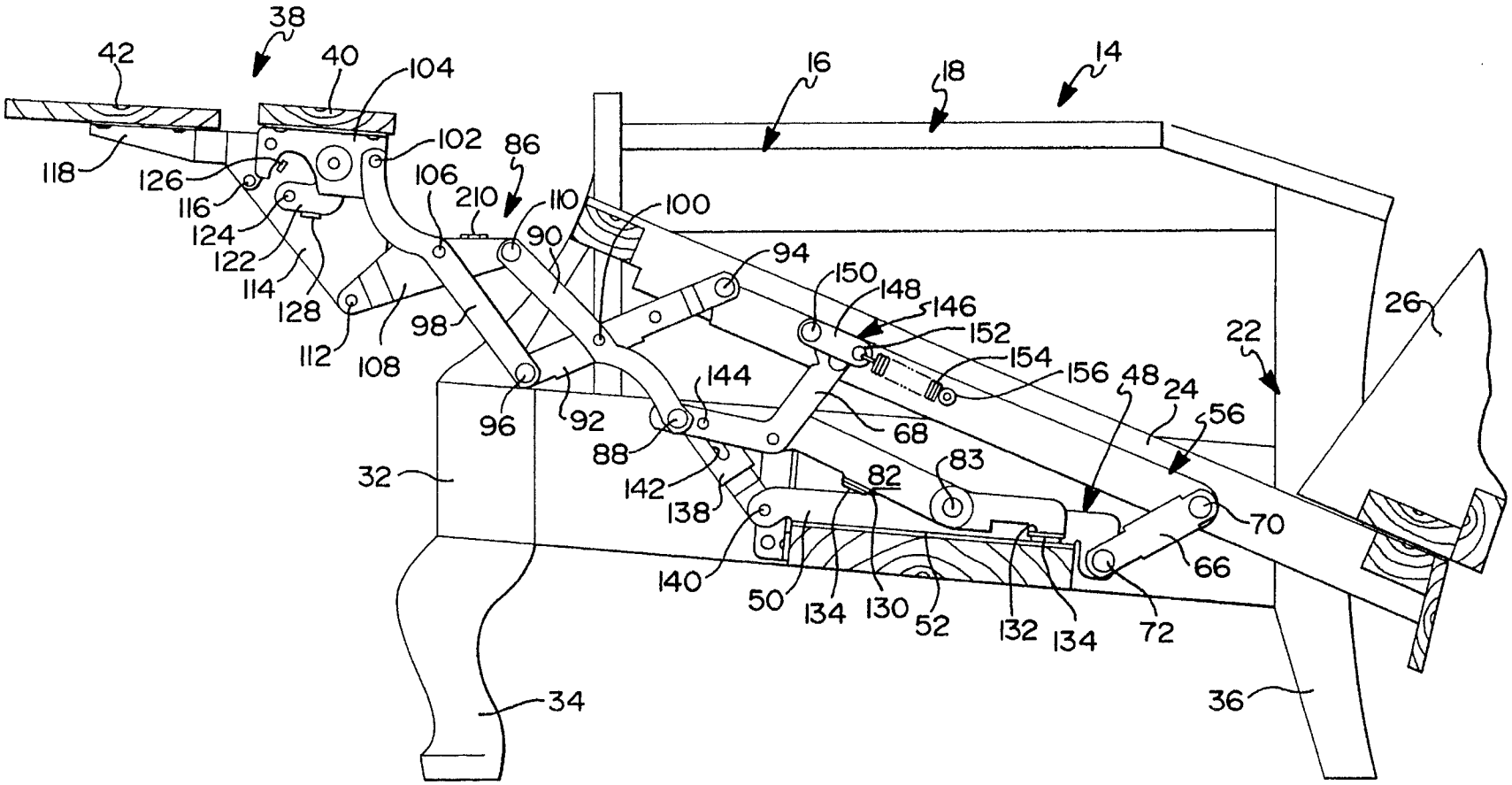
FIG. 5 is a side elevational view of the actuation mechanism when the high-leg reclining chair is in the "tilted" position of FIG. 2C.

With particular reference to FIGS. 3 through 5, a preferred embodiment of actuation mechanism 12 will be disclosed in greater detail. As will be noted, the upholstery and underlying springs, padding, etc. for the various components has been omitted to more clearly illustrate the present invention. In general, actuation mechanism 12 comprises a pair of laterally-spaced linkage mechanisms 46, with each linkage mechanism 46 being located adjacent one of side members 16 and operably interconnecting one lateral edge of seat member 24 to cross member 20. Since each linkage mechanism 46 is substantially identical for providing synchronous operation therebetween, the following description is directed to only one of linkage mechanisms 46.

Linkage mechanism 46 includes an elongated base bracket 48 having a vertical flange segment 50 and a horizontal flange segment 52. Horizontal flange segment 52 includes a plurality of mounting apertures (not shown) that are adapted to receive suitable fasteners for securing base bracket 48 to an upper surface of cross member 20. In addition, linkage mechanism 46 also includes an elongated seat bracket 56 having a vertical flange segment 58 that is adapted for alignment adjacent to the inner lateral surface of seat member 24, and a transverse flange segment 60 that is adapted for alignment with the bottom surface of seat member 24. Thereafter, suitable threaded fasteners are driven through a plurality of mounting apertures (not shown) formed in transverse flange segment 60 and into the bottom surface of seat member 24 for securing seat bracket 56 to seat member 24.

To provide means for supporting seat assembly 22 for reclining movement relative to chair frame 14, seat bracket 56 is interconnected to base bracket 48 by means of a rear swing link 66 and a front swing link 68. More specifically, an upper end of rear swing link 66 is pivotably coupled at pivot 70 to a rear portion of vertical flange segment 58 on seat bracket 56 while its lower end is pivotably coupled at pivot 72 to a downwardly extending projection 74 formed at a rearward portion of vertical flange segment 50 on base bracket 48. In addition, front swing link 68 has an upper end pivotably coupled at pivot 76 to a front portion of vertical flange segment 58 on seat bracket 56 while an intermediate portion thereof is pivotably coupled at pivot 80 to a front portion of a tilt bar 82 which, in turn, is pivotably coupled at pivot 83 to vertical flange segment 50 of base bracket 48.

In this manner, seat member 24 and, in turn, seat assembly 22 are operably suspended from cross member 20 of chair frame 14 for reclining movement.

Linkage mechanism 46 also includes a pantograph linkage 84 for causing articulated movement of primary leg-rest segment 40 and secondary leg-rest segment 42 of leg rest assembly 38 between their respective "stowed" and "extended" positions. In general, pantograph linkage 84 is interconnected between seat bracket 56 and front swing link 68 such that extensible articulated movement of leg rest assembly 38 is concurrent (i.e., coordinated) with reclining movement of seat assembly 22. More particularly, leg rest pantograph linkage 84 is suspended relative to seat member 24 by means of a lower end of front swing link 68 being pivotably coupled at pivot 88 to a lower rearward end of a long drive link 90, and a seat link 92 having a first end pivotably coupled at pivot 94 to a front portion of seat bracket vertical flange 58 and a second end pivotably coupled at pivot 96 to a lower rearward end of a first connecting link 98. In addition, an intermediate portion of seat link 92 is pivotably coupled at pivot 100 to an intermediate portion of drive link 90. The upper forward end of first connecting link 98 is pivotably coupled at pivot 102 to a rear portion of a primary leg-rest mounting bracket 104 to which primary leg-rest segment 40 is suitably mounted. An intermediate portion of first connecting link 98 is pivotably coupled at pivot 106 to a mid-segment of a triangular link 108 which is pivotably coupled at one end to the upper forward end of drive link 90 about pivot 110. The opposite end of triangular link 108 is pivotably coupled at pivot 112 to one end of a second connecting link 114. As can be seen, second connecting link 114 is an enlarged link member that acts as a shield plate for concealing potential pinch-points in pantograph linkage 84. The opposite end of second connecting link 114 is pivotably coupled at pivot 116 to a secondary leg-rest mounting bracket 118 to which secondary leg-rest segment 42 is suitably mounted. Moreover, primary and secondary leg-rest mounting brackets 104 and 118, respectively, are interconnected for pivotable movement about pivot 120. Finally, a short cross link 122 has one end pivotably coupled at pivot 124 to an intermediate portion of second connecting link 114 and its opposite end is pivotably coupled at pivot 125 to primary leg-rest bracket 104.

To provide means for mechanically limiting the range of extensible articulated movement of leg rest pantograph linkage 84 for defining the fully "stowed" and "extended" positions of leg rest assembly 38, second connecting link 114 has first and second cold-deformed or "lanced" stop protrusions 126 and 128, respectively, formed therein which are oriented to abut with adjacent sides of short cross link 122 upon pivotable movement thereof. This placement of stop protrusions 126 and 128 in close proximity to the distal end of pantograph linkage 84 not only defines the two extreme leg rest positions, but also provides enhanced linkage rigidity. Accordingly, such placement of the positive stop arrangement at the distal end of pantograph linkage 84 effectively inhibits the tendency of leg rest assembly 38 to "droop" relative to chair frame 14.

To provide means for establishing the limits of "tilting" movement of seat assembly 22, tilt bar 82 has a front stop flange 130 that is adapted to maintain engagement with a forward portion of horizontal flange segment 52 on base bracket 48 when seat assembly 22 is "reclined" to any position between the "upright" and "T.V." positions of FIGS. 3 and 4, respectively. However, upon rearward "tilting" movement of seat assembly 22 from the "T.V." position (FIG. 4) toward the "fully" reclined position (FIG. 5), tilt bar 82 rotates about pivot 83 until a rear stop flange 132 formed thereon engages a rearward portion of horizontal flange section 52 on base bracket 48 to establish the "fully" reclined position. Thus, upon "tilting" movement of seat assembly 22, tilt bar 82 is caused to concurrently rotate about pivot 83 relative to base bracket 48 such that the extent of such tilting movement is defined upon abutting contact between one of front stop flange 130 and rear stop flange 132 with base bracket 48. As an additional feature, plastic stops 134 are fixed to front and rear stop flanges 130 and 132, respectively, to minimize the propagation of noise upon engagement with horizontal flange segment 52 of base bracket 48. Furthermore, to guide a front portion of seat member 24 during tilting movement of seat assembly 22, a guide link 138 is provided having a first end pivotably coupled at pivot 140 to a front portion of base bracket vertical flange 50 and an elongated guide slot 142 formed in its distal end. An optional bushing (not shown) made of nylon or other like material may be utilized in conjunction with the connection of guide link 138 and elongated guide slot 142 to reduce noise and enhance wearability of the components. A follower, such as rivet 144, extends through guide slot 142 and is fixed to the lower end of front swing link 68 near pivot 88.

In accordance with yet another feature of the present invention, an over-center biasing arrangement 146 is provided for assisting in extending and retracting leg rest pantograph linkage 84 and in retaining leg rest assembly 38 in one of its "stowed" and "extended" positions. This over-center biasing arrangement 146 works in conjunction with stop protrusions 126 and 128 on second connecting link 114 to effectively inhibit undesirable "droop" of leg rest assembly 38 in either of its "stowed" or "extended" positions. More particularly, over-center biasing arrangement 146 includes an over-center link 148 having a first end that is pivotably coupled at pivot 150 to an extended upper segment of front swing link 68. The opposite end of over-center link 148 has an aperture 152 which is adapted to receive a first hooked end of a coil spring 154, the other hooked end thereof being secured to a post 156 extending inwardly from vertical flange segment 58 of seat bracket 56. In the FIG. 3 position, an imaginary "line-of-action" between pivot 150 and post 158 is below pivot 76 of front swing link 68 such that the biasing of coil spring 154 pulls on over-center link 148 and pantograph linkage 84 for assisting in maintaining leg rest assembly 38 in its fully retracted "stowed" position. Upon articulated extension of leg rest assembly 38 toward its "extended" position, the "line-of-action" passes across pivot 76 (i.e., goes "over-center") such that coil spring 154 again acts on over-center link 148 and pantograph linkage 84 for biasing leg rest assembly 38 toward its fully "extended" position. It is to be appreciated that over-center biasing arrangement 146 maximizes the spring force output of coil spring 154 while concomitantly minimizing the longitudinal extension of spring 154, thereby increasing its useful life.

With particular reference to FIG. 3 of the drawings, high-leg reclining chair 10 is shown positioned in the "fully" upright position with leg rest assembly 38 in its "stowed" position. In such a conventional seated position, tilt bar 82 is aligned such that plastic stop 134 on front stop flange 130 rest on a forward portion of base bracket horizontal flange segment 52. In addition, first stop protrusion 126 (FIG. 4) engages its respective one of the adjacent edges of short cross link 122 to assist in maintaining leg rest assembly 38 in its fully retracted position. Moreover, over-center link 148 of over-center biasing arrangement 146 is concurrently shown to be positioned such that its "line-of-action" is below pivot 76 of front swing link 68.

When it is desired to move seat assembly 22 relative to chair frame 14 from the "upright" position toward the first reclined or "T.V." position, the seat occupant applies rearward pressure upon seatback member 26, thereby causing seat assembly 22 to move in a substantially rearward direction relative to cross member 20 by the coordinated rearward pivotable movement of rear swing link 66 about pivot 72 and front swing link 68 about pivot 80. Such pivotable movement of front swing link 68 about pivot 80 causes long drive link 90 to be concurrently urged forwardly and upwardly so as to also urge first connecting link 98 forwardly and upwardly due to their interconnection with seat link 92. Accordingly, such forward and upward driven motion of front swing link 68 in response to rearward reclining movement of seat assembly 22 causes pantograph linkage 84 to be concurrently and proportionately articulated for moving leg rest assembly 38 from the "stowed" position of FIG. 3 toward the fully "extended" position of FIG. 4. When leg rest assembly 38 is in the fully "extended" position, second stop protrusion 128 is in engagement with the opposite lateral edge of short cross link 122 at the distal end of pantograph linkage 84. As can also be seen, tilt bar 82 does not change its orientation during such articulated movement of leg rest assembly 38, whereby plastic stop 134 on front stop flange 130 maintains engagement with the forward portion of base bracket vertical flange section 52. In addition, during such extensible movement of leg rest assembly 38, pivotable movement of front swing link 68 causes over-center link 148 to move "over-center" relative to front swing link pivot 76 such that the pre-loaded biasing of coil spring 154 is capable of assisting the seat occupant in moving leg rest assembly 38 toward its fully "extended" position. It will be understood that additional leverage can be applied by the seat occupant by pushing on chair arms 18 to assist in the coordinated movement of seat assembly 22 and leg rest assembly 38. To return chair 10 to the "upright" position, the seat occupant merely leans forward on seat assembly 22 and exerts downward leg pressure on the extended leg rest segments.

When it is desired to rearwardly tilt seat assembly 22 from the "T.V." position of FIG. 4 toward the "fully" reclined position of FIG. 5, the seat occupant need bring only slight additional rearward pressure to bear upon seatback member 26 where upon the forward end of tilt bar 82 is urged upwardly due to its interconnection at pivot 80 to front swing link 68 for causing tilt bar 82 to rearwardly rotate about its pivot 83. During such angular movement, seat assembly 22 is tilted about rear swing link pivot 72 until plastic stop 134 on rear stop flange 132 engages the rear portion of horizontal flange segment 52 on base bracket 48. Upon such occurrence, seat assembly 22 is located and retained in the "fully" reclined position relative to chair frame 14. Concurrent with such angular tilting movement of seat assembly 22, follower 144 moves upwardly with front swing link 68 for causing pivotable movement of guide link 138 about pivot 140. As will be appreciated, the seat occupant can easily and quickly move seat assembly 22 from the "fully" reclined position to the "T.V." position, or any position therebetween, by forwardly shifting his weight on seat member 24 or exerting a slight downward pressure upon leg rest assembly 38) either movement causing tilt bar 82 to forwardly rotate about pivot 83.

Figure 6:
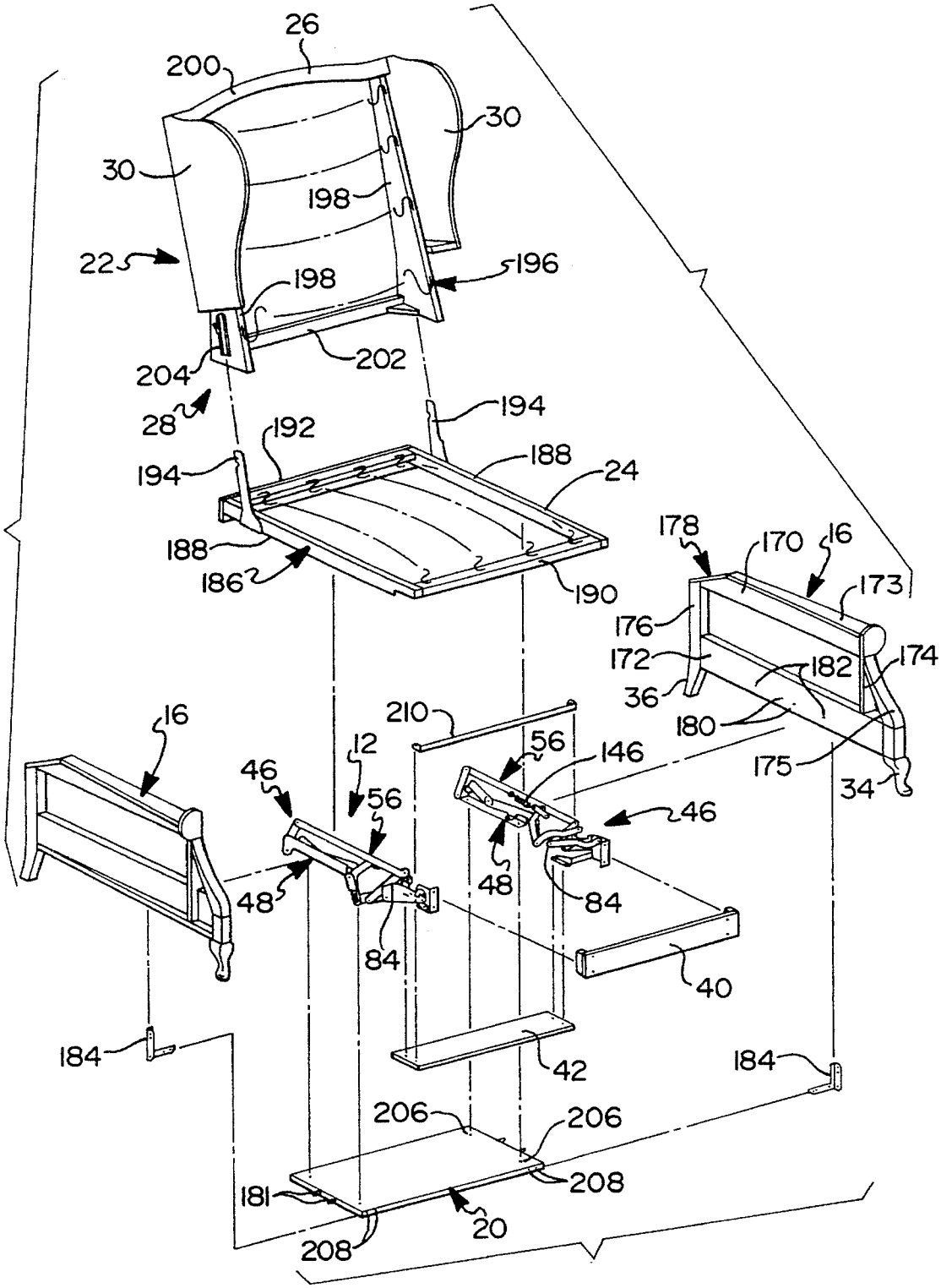
FIG. 6 is an exploded perspective view of the high-leg reclining chair shown in FIG. 1 with its upholstery, springs and other parts removed for illustrating a method of assembling the actuation mechanism between modular seat assembly and high-leg chair frame components.

While it is believed that the above disclosure presents novel structural features and advantages not found in conventional high-leg reclining chairs, a primary design feature of the present invention is directed to a unique method for quickly and efficiently assembling the modular components. To this end, FIG. 6 presents an exploded perspective view of high-leg reclining chair 10 with its various pre-assembled and/or pre-upholstered members shown with their upholstery, padding, springs, etc. removed to more clearly illustrate the modular nature of the components. In essence, most of the above-described members can be individually fabricated or sub-assembled to include the requisite brackets, springs, padding and upholstery on an "off-line" batch-type basis.

Left and right side members 16 are each constructed as rigid, roughly rectangular wooden frame components having bottom and top members 170 and 172, respectively, with top members 170 including a horizontal rail 173 functioning as chair arms 18. Each side member 16 also includes a front post 174 and an angled rail 175 in addition to front corner post 32 to which front legs 34 are secured. In addition, each side member 16 has an inclined rear post member 176 integrally forming rear leg 36 such that front and rear posts 174 and 176, respectively, and top and bottom members 170 and 172, respectively, are rigidly secured together as a side frame 178. Moreover, bottom member 170 has a first set of aligned bores 180 formed therein that are sized to receive dowel pins 181 extending from opposite ends of cross member 20. A second set of aligned bores 182 are formed in bottom member 170 to provide means for securing angled brackets 184 between a front edge of cross member 20 and side frames 178. Since the first and second sets of aligned bores 180 and 182, respectively, are oriented in a predetermined arrangement on side frames 178, it is apparent that all critical hole locations may be drilled in a single operation.

With continued reference to FIG. 6 of the drawings, seat member 24 is shown to include a seat frame 186 which is located between side frames 178 and supported for reclining and tilting movement on cross member 20. More specifically, seat frame 186 is a rigid rectangular structure having left and right side rails 188 which are rigidly secured to opposite ends of front and rear cross rails 190 and 192, respectively. In view of the compact nature of actuation mechanism 12, seat frame 186 is non-contoured (i.e. "flat") which also permits use of loose cushions, if desired. As noted, seat frame 186 is supported for movement relative to side frames 178 to move substantially horizontally and slightly up or down, depending on whether seat frame 186 moves rearwardly (during "reclining" movement) or forwardly (on return to the "upright" position). A support link 194 is fixed to a rear portion of each side rail 188 to provide means for securing seatback member 26 thereto. As noted, seat bracket 56 has a transverse flange portion 60 that is securely fixed (such as by wood screws) to an underside surface of a seat side rails 188. Support link 194 also has a transverse flange portion (not shown) which enables support link to be similarly securely fixed to the underside surface of seat side rails 188 at the same time as seat bracket 56. Accordingly, seat 24 can be readily pre-assembled and upholstered prior to final assembly.

Seatback member 26 is constructed to include a seatback frame 196 that is in the form of a rigid relatively rectangular assembly. Seatback frame 196 includes right and left side rails 198 and upper and lower cross rails 200 and 202, respectively. As noted, detachable means 28 are provided such that seatback frame 196 can be removably mounted to an upper portion of rear support links 194 on seat frame 186 by means of slide brackets 204 secured at suitable locations on side members 198. A preferred construction of slide brackets 204 for this type of mounting is shown and described in U.S. Pat. No. 5,184,871, assigned to the common assignee of the present invention, the disclosure of which is expressly incorporated by reference herein. In general, slide brackets 204 are channel-shaped to provide an interior track that slidably receives rear support links 194 therein. When slide brackets 204 are mounted on rear support links 194, seatback member 26 is, in effect, an extension of seat member 24. As such, seatback member 26 acts as a lever arm for causing relatively easy angularly movement of seat assembly 22. Prior known seatbacks in high-leg chairs have been attached to their respective seat members by a rather complex series of dowel joints and scab blocks to provide the level of rigidity desired between the seatback and seat member. The detachable means 28 of high-leg reclining chair 10 provides a convenient and more efficient way of joining the seatback to the seat member that eliminates the several assembly operations required in prior known methods. In addition, upholstery of the seatback and seat member is made easier because each component can be upholstered separately and then assembled together. Optionally, rear support link 194 may be tapered, in which case slide brackets 204 are correspondingly tapered to receive link 194. Such a taper provides additional rigidity to the joint formed between the seatback and seat member.

According to a preferred method for assembling reclining chair 10, pre-upholstered seat member 24 is turned over to expose side rails 188 of seat frame 186. Upon aligning and locating seat bracket 56 for each linkage mechanisms 46 with respect to side rails 188, threaded fasteners are driven through mounting apertures in transverse flange segment 60 and into pre-drilled bores (not shown) formed in the bottom surface of side rails 188 for securing seat bracket 56 to seat member 24. Simultaneously, rear support links 194 are secured to the bottom surface of side rails 188. Following interconnection of both linkage mechanisms 46 and support links 194 to seat member 24, pre-drilled alignment bores 206 in cross member 20 are aligned with the mounting apertures in horizontal flange segment 52 of base bracket 48. Thereafter, threaded fasteners are driven through the aligned bores for rigidly securing the pair of laterally-spaced linkage mechanisms 46 to cross member 22. Next, dowel pins 187 extending from lateral ends of cross member 22 are inserted into the first set of bores 180 of each side frame 178 which have been pre-upholstered to define side members 16. A suitable adhesive may be used if desired. Thereafter, angled brackets 184 are aligned with the second set of bores 182 in side frames 178 and bores 208 in the front edge of cross member 20 and suitable fasteners are driven therethrough for fixing cross member 20 to side frames 178. Following such assembly of chair frame 14, leg-rest segments 40 and 42 are fixedly secured to mounting brackets 104 and 118, respectively, in a suitable manner. In addition, a cross beam 210 is secured between the laterally-spaced pair of pantograph linkages 84 to provide additional rigidity and limit accessibility therebetween. Finally, chair frame 14 is "flipped over" to permit slide brackets 204 to be detachable inserted over support links 194 for attaching seatback member 26 to seat member 24.

As an alternative to the above method and following fixation of linkages 46 to side rails 188 of seat frame 178, seat member 24 (with actuation mechanism 12 supported therefrom) can be installed on a "pre-assembled" chair frame 14. More specifically, following assembly of chair frame 14 from its modular frame components, bores 206 in cross member 20 are aligned with the mounting apertures in horizontal flange segment 52 of base bracket 48. Thereafter, threaded fasteners are driven through the aligned bores for rigidly securing actuation mechanism 12 and seat member 24 to the pre-assembled chair frame 14. Thus, it will be appreciated that various other sequential operation can be utilized for interconnecting the various components into high-leg reclining chair 10.

The foregoing discussion discloses and describes exemplary embodiments of the present invention. One skilled in the art will readily recognize from such discussion, and from the accompanying drawings and claims, that various changes, modifications and variations can be made therein without departing from the true spirit and fair scope of the invention as defined in the following claims.

What is claimed is:

1. A reclining chair comprising:

a high-leg chair frame having a cross member;

a seat assembly having a seat member and a seatback member;

means for detachably securing said seatback member to said seat member;

a leg rest assembly movable between a retracted and an extended position;

an actuation mechanism defined by a pair of laterally spaced linkage mechanisms operably interconnecting said seat assembly and said leg rest assembly for movement relative to said chair frame between a non-reclined position, a first reclined position and a second reclined position, each of said linkages including:

a base bracket mounted to said cross member;

first linkage means including-a front swing link and a rear swing link pivotally interconnected to said seat member and operably interconnected to said base bracket for causing reclining movement of said seat assembly in response to pressure applied by a seat occupant to said seatback member;

second linkage means including a pantograph linkage supporting said leg rest assembly and interconnected between said seat member and said front swing link for causing concurrent movement of said leg rest assembly between said retracted position and said extended position in response to movement of said seat assembly between said non-reclined position and said first reclined position, respectively, and first stop means for limiting the range of extensible movement of said pantograph linkage to define said retracted and extended positions of said leg rest assembly;

third linkage means including a tilt member pivotally interconnected to said base bracket for angularly tilting said seat assembly between said first reclined position and a second reclined position independent of movement of said leg rest assembly, said tilt member having a front stop engagable with said base bracket when said seat assembly is in said non-reclined position or said first reclined position and a rear stop engageable with said base bracket when said seat assembly is in said second reclined position; and over-center biasing means interconnected between said base bracket and said front swing link for biasing said leg rest assembly toward said retracted and extended positions, said over-center biasing means including an over-center link having a first end pivotably connected to said front swing link and spring means interconnecting a second end of said over-center link to said seat member for driving said leg rest assembly towards said extended position when said pivot connection of said first end is above said pivot connection between said front swing link and said seat member and for driving said leg rest assembly towards said retracted position when said pivot of said first end is below said pivot connection between said front swing link and said seat member.

2. The reclining chair of claim 1 wherein said leg rest assembly includes a primary leg rest segment and a secondary leg rest segment interconnected by said pantograph linkage for articulated movement such that in said retracted position said secondary leg rest segment is generally transversely oriented relative to said primary leg rest segment and concealed within said chair frame, and in said extended position said primary and secondary leg rest segments are in substantially coplanar alignment.

3. The reclining chair of claim 1 wherein said high-leg chair frame is supported off the floor on four exposed legs and includes a pair of side members interconnected by said cross member such that said seat assembly is supported for movement relative to said chair frame.

4. The reclining chair of claim 1 further comprising guide linkage means distinct from said third linkage means and interconnected between said chair frame and said actuation mechanism for supporting a front portion of said seat member during tilting of said seat assembly.

5. A reclining chair comprising:

a high leg chair frame;

a seat assembly having a seat member and a seatback member;

a leg rest assembly operably interconnected between said chair frame and said seat assembly and movable between a retracted position and an extended position;

a four-bar linkage mechanism defined by a pair of laterally spaced linkages operably interconnecting said seat assembly and said chair frame to recline said seat assembly between a non-reclined position and a first reclined position, each of said linkages including a front swing link and a rear swing link pivotally interconnected between said seat assembly and said chair frame;

an over-center biasing mechanism including an over-center link having a first end pivotally connected to said front swing link and a spring interconnected between a second end of said over-center link and said seat member, said over-center biasing mechanism biasing said leg rest assembly toward said retracted position when said seat assembly is in said non-reclined position and toward said extended position when said seat assembly is in said first reclined position;

a tilt mechanism operably interconnecting said four-bar linkage mechanism and said chair frame to tilt said seat assembly between said first reclined position and a second reclined position; and a guide linkage mechanism distinct from said tilt mechanism and interconnecting said chair frame and said four-bar linkage mechanism to support a front portion of said seat member during tilting thereof.

6. The reclining chair of claim 5 wherein said leg rest assembly further comprises:

a pantograph linkage mechanism having a proximate end and a distal end;

a primary leg rest board disposed at said distal end of said pantograph linkage mechanism; and said proximate end of said pantograph linkage being operably interconnected to said seat assembly and said four-bar linkage mechanism to retract and extend said primary leg rest board in coordination with said reclining motion of said seat assembly.

7. The reclining chair of claim 6 wherein said leg rest assembly further comprises a secondary leg rest board disposed on said pantograph linkage mechanism between said primary leg rest board and said proximate end.

8. The reclining chair of claim 6 further comprising a leg rest stop provided on said pantograph linkage mechanism to mechanically limit the range of extensible articulated movement of said leg rest assembly.

9. The reclining chair of claim 8 wherein said leg rest stop comprises a first stop to limit the retraction of said pantograph linkage mechanism and a second stop to limit the extension of said pantograph linkage mechanism, said first and second stops being disposed in close proximity to said distal end of said pantograph linkage mechanism.

10. The reclining chair of claim 5 further comprising seat assembly stop provided on said tilt mechanism to mechanically limit the range of angular tilting of said seat assembly relative to said chair frame.

11. The reclining chair of claim 10 wherein said seat assembly stop comprises a front stop to limit the angular tilting of a portion of said four-bar linkage mechanism in said non-reclined or first reclined positions and a rear stop to limit the angular tilting of said portion of said four-bar linkage mechanism in said second reclined position, said front and rear stops being disposed on said tilt mechanism.

12. The reclining chair of claim 5 wherein said guide linkage mechanism includes a guide link having a first end pivotally interconnected to said chair frame and a second end operably interconnected to said four-bar linkage mechanism.

13. The reclining chair of claim 12 wherein said guide linkage mechanism further comprises:

a follower pin extending from said four-bar linkage mechanism; and said second end of said guide link having a slot formed therein for receiving said follower pin to support said front portion of said seat assembly during angular tilting of said seat assembly between said first and second reclined positions.

14. A reclining chair comprising:

a high leg chair frame;

a seat assembly having a seat member and a seatback member;

a leg rest assembly operably interconnected between said chair frame and said seat assembly and movable between a retracted position and an extended position;

a four-bar linkage mechanism defined by a pair of laterally spaced linkages operably interconnecting said seat assembly and said chair frame to recline said seat assembly between a non-reclined position and a first reclined position, each of said linkages including a front swing link and a rear swing link pivotally interconnected between said seat assembly and said chair frame;

an over-center biasing mechanism including an over-center link having a first end pivotally connected to said front swing link and a spring interconnected between a second end of said over-center link and said seat member, said over-center biasing mechanism biasing said leg rest assembly toward said retracted position when said seat assembly is in said non-reclined position and toward said extended position when said seat assembly is in said first reclined position; and a tilt mechanism operably interconnecting said four-bar linkage mechanism and said chair frame to tilt said seat assembly between said first reclined position and a second reclined position.

15. The reclining chair of claim 14 wherein said leg rest assembly comprises:

a pantograph linkage mechanism having a proximate end and a distal end;

a primary leg rest board disposed at said distal end of said pantograph linkage mechanism; and said proximate end of said pantograph linkage being operably interconnected to said seat assembly and said four-bar linkage mechanism to retract and extend said primary leg rest board in coordination with said reclining motion of said seat assembly.

16. The reclining chair of claim 15 further comprising a leg rest stop provided on said pantograph linkage mechanism to mechanically limit the range of extensible movement of said leg rest assembly, said leg rest stop including a first stop to limit the retraction of said pantograph linkage mechanism and a second stop to limit the extension of said pantograph linkage mechanism, said first and second stops being disposed in close proximity to said distal end of said pantograph linkage mechanism.

17. The reclining chair of claim 15 further comprising a seat assembly stop disposed on said tilt mechanism and including a front stop to limit the angular tilting of a portion of said four-bar linkage mechanism in said non-reclined or first reclined positions and a rear stop to limit the angular tilting of said portion of said four-bar linkage mechanism in said second reclined position.

18. The reclining chair of claim 15 further comprising a guide linkage mechanism distinct from said tilt mechanism and interconnecting said chair frame and said four-bar linkage mechanism to support a front portion of said seat member during tilting thereof.

19. The reclining chair of claim 18 wherein said guide linkage mechanism further comprises:

a guide link having a first end pivotally interconnected to said chair frame and a second end operably interconnected to said four-bar linkage mechanism;

a follower pin extending from said four-bar linkage mechanism; and said second end of said guide link having a slot formed therein for receiving said follower pin to support said front portion of said seat assembly during angular tilting of said seat assembly between said first and second reclined positions.

* * * * *